US006351944B1

(12) United States Patent
Fertig et al.

(10) Patent No.: US 6,351,944 B1
(45) Date of Patent: Mar. 5, 2002

(54) HYDRAULIC CONTROL MECHANISM FOR A MOBILE MACHINE TOOL, ESPECIALLY A WHEEL LOADER, FOR DAMPING LONGITUDINAL OSCILLATIONS

(75) Inventors: Günter Fertig, Wertheim; Georg Rausch, Lohr/Main, both of (DE)

(73) Assignee: Mannesmann Rexroth AG, Lohr/Main (DE)

( * ) Notice: Subject to any disclaimer, the term of this patent is extended or adjusted under 35 U.S.C. 154(b) by 0 days.

(21) Appl. No.: 09/581,301

(22) PCT Filed: Nov. 21, 1998

(86) PCT No.: PCT/EP98/07509

§ 371 Date: Jun. 9, 2000

§ 102(e) Date: Jun. 9, 2000

(87) PCT Pub. No.: WO99/29970

PCT Pub. Date: Jun. 17, 1999

(30) Foreign Application Priority Data

Dec. 10, 1997 (DE) ..... 197 54 828

(51) Int. Cl.[7] ..... F16D 31/02
(52) U.S. Cl. ..... 60/413
(58) Field of Search ..... 60/413, 469, 414

(56) References Cited

U.S. PATENT DOCUMENTS

| | | | | |
|---|---|---|---|---|
| 4,995,517 A | | 2/1991 | Yoshimi | 60/413 |
| 5,034,892 A | | 7/1991 | Yoshimi | 60/413 |
| 5,245,826 A | * | 9/1993 | Roth et al. | 60/413 |
| 5,513,491 A | | 5/1996 | Broenner et al. | 60/413 |

FOREIGN PATENT DOCUMENTS

| | | |
|---|---|---|
| DE | 3909205 | 5/1990 |
| DE | 68918930 | 8/1990 |
| DE | 4129509 | 3/1993 |
| DE | 4221943 | 3/1993 |
| DE | 4416228 | 11/1995 |
| DE | 19608758 | 9/1997 |
| FR | 2747447 | 10/1997 |
| FR | 2747448 | 10/1997 |
| FR | 2754001 | 4/1998 |

OTHER PUBLICATIONS

Patent Abstracts of Japan, vol. 012, No. 347 (M–743), Sep. 19, 88—& JP 63 106404 A (KOMATSU LTD, May 11, 1988.

Patent Abstracts of Japan, vol. 014, No. 464 (M–1033) Oct. 9, 1990, —& JP 02 186020 A (YUTANI HEAVY IND LTD), Jul. 20, 1990.

* cited by examiner

*Primary Examiner*—Edward K. Look
*Assistant Examiner*—Thomas E. Lazo
(74) *Attorney, Agent, or Firm*—Martin A. Farber

(57) ABSTRACT

A hydraulic control arrangement for a mobile working machine which serves for damping pitching vibrations and has a hydraulic accumulator which can be connected to a hydraulic fluid source via a filling valve and which can be connected to a pressure chamber of a hydraulic cylinder, and a shut off valve which, with a first condition fulfilled, can be moved into a through position in which hydraulic fluid can flow through it in the direction from the hydraulic accumulator to the pressure chamber of the hydraulic cylinder and vice versa. The shut off valve may, at the same time, also be the filling valve. A first condition may be that a certain traveling speed is exceeded. Limiting the accumulator pressure to a limit pressure is intended to keep the wear on the hydraulic accumulator low and to increase the safety. These two aims are achieved to better effect, wherein the shut off valve can also be moved, with the first condition fulfilled, into its shut off position when the load pressure in the pressure chamber of the hydraulic cylinder or the accumulator pressure reaches a maximum pressure.

20 Claims, 7 Drawing Sheets

HYDRAULIC CONTROL MECHANISM FOR A MOBILE MACHINE TOOL, ESPECIALLY A WHEEL LOADER, FOR DAMPING LONGITUDINAL OSCILLATIONS

FIELD AND BACKGROUND OF THE INVENTION

The invention takes relates to a hydraulic control arrangement which is used for a mobile working machine, in particular for a wheel loader.

It is known from DE 39 09 205 C1 to damp the pitching vibrations of wheel loaders which occur, in particular, with the loading shovel full and at relatively high traveling speed, using a damping system which is a constituent part of the hydraulic control arrangement of the wheel loader. For the purpose of vibration damping, the generally two hydraulic lifting cylinders for raising and lowering the loading shovels can be connected via a shut-off valve to a hydraulic accumulator which can be charged to a limit pressure by a hydraulic pump, via a filling line which branches off from the pump line upstream of the directional control valve block and in which a filling valve is located. The shut-off valve, which is arranged between the hydraulic accumulator and the lifting cylinders, is closed as long as the loading shovel is working, and can be opened by the driver or automatically as soon as pitching vibrations occur during travel or as soon as the traveling speed is above a certain value, e.g. above 6 km/h.

The hydraulic fluids can then flow back and forth freely between the lifting cylinders and the hydraulic accumulator, with the result that the loading shovel is no longer connected rigidly to the vehicle body and the pitching vibrations are damped. Relative movement between the loading shovel and vehicle body makes it possible for the pressures occurring in the lifting cylinders and the hydraulic accumulator to be high enough to shorten the service life of the hydraulic accumulators. The hydraulic accumulator is also subjected to very high pressure loading when, with the shut-off valve open, the directional control valve assigned to the lifting cylinders is actuated and the lifting cylinders are extended to their full extent.

Another damping system against pitching vibrations, which is likewise part of the hydraulic control arrangement of a working machine, is known from DE 41 29 509 C2. In this case, the filling line branches off from a working line which runs between the lifting cylinders and the directional control valve assigned thereto. The shut-off valve arranged in the filling line is, at the same time, the filling valve and pressure-controlled and can be opened by the load pressure, prevailing in the working line, of the lifting cylinders counter to the accumulator pressure, which acts on a rear control chamber on the valve element of the shut-off valve, and counter to the force of a weak compression spring. The accumulator pressure is thus in each case only slightly lower than the highest load pressure of the lifting cylinders which occurs during a working cycle. In order to damp the pitching vibrations, the rear control chamber of the shut-off valve is relieved of loading in relation to the tank via a pilot valve, with the result that the shut-off valve opens and hydraulic fluids can be pushed back and forth freely between the hydraulic accumulator and the lifting cylinders.

In a development of the hydraulic control arrangement according to DE 41 29 509 C2, it is known from DE 196 08 758 A1 to arrange, upstream of said pilot valve, a second, pressure-controlled pilot valve which, provided the load pressure in the lifting cylinders and in the working line does not exceed a predetermined limit pressure, passes on the accumulator pressure, and when the limit pressure is exceeded passes on the load pressure, to the first pilot valve. Thus, when the first pilot valve is located in its rest position, that is to say when the damping system against pitching vibrations is not switched on, the rear control chamber is subjected to the action of the accumulator pressure when the load pressure is lower than the limit pressure and is subjected to the action of the load pressure when the load pressure is higher than the limit pressure. In the latter case, the shut-off valve closes, with the result that the hydraulic accumulator is protected against pressures exceeding the limit pressure. If, however, the rear control chamber is connected to the tank via the first pilot valve, then it is also the case with the hydraulic control arrangement according to DE 196 08 758 A1 that the protection of the hydraulic accumulator is no longer successful. The latter may be subjected to the action of pressures which far exceed the limit pressure and are caused by the relative movement between the loading shovel and the vehicle body. It is likewise possible for a very high pressure to occur in the hydraulic accumulator when, with the first pilot valve in operation and the shut-off valve thus open, the directional control valve assigned to the lifting cylinders is actuated and the lifting cylinders are moved against a stop.

SUMMARY OF THE INVENTION

The object of the invention is thus to develop further a hydraulic control arrangement of the above mentioned type, such that, with the condition under which the shut-off valve can be moved into its through position fulfilled, e.g. at a higher traveling speed than 6 km/h or following actuation of an electric switch by the driver or in the case of a certain lifting height of the loading shovel, the hydraulic accumulator is also protected against pressures which are severely detrimental to the service life.

This object is achieved, in the case of a hydraulic control arrangement of the above-mentioned type, wherein the shut-off valve can also be moved, with the first condition fulfilled, into its shut-off position when the load pressure in the pressure chamber of the hydraulic cylinder or the accumulator pressure reaches a maximum pressure. In this way, pressures which are above the maximum pressure are also kept away from the hydraulic accumulator when a "damping system on" signal is present. In this case, according to another feature of the invention, the maximum pressure is advantageously selected to be higher than the limit pressure. This does not yet stress the hydraulic accumulator excessively since, when the damping system is activated or in the standby state, the number of changes between pressure increase and pressure decrease, the absolute level of the changes in pressure and the change in pressure over time are generally lower than during an operating cycle during which time a material is received or displaced by the loading shovel.

According to another feature of the invention hydraulic control arrangement has a shut-off valve which assumes a shut-off position under the action of a spring and, by activation of an actuating element, can be switched over into the through position. In a particularly straightforward manner, it is provided, then, that the actuating element is deactivated when the load pressure or the accumulator pressure reaches the maximum pressure. If the shut-off valve is actuated, for example, by an electromagnet, then the load pressure or the accumulator pressure can be sensed by an electric pressure sensor which emits a signal when it establishes the maximum pressure. The signal is passed onto an electric control unit which switches off the electromagnet. Of course, the pressure sensor may also be formed by a pressure switch located directly in the power circuit of the electromagnet. The pressure sensor or pressure switch can easily be adjusted to a maximum pressure which is higher than the limit pressure.

Alternatively, the shut-off valve can be switched over by an actuating piston, which acts counter to the activated actuating element and a spring and is subjected to the action of the load pressure or the accumulator pressure, from the through position into the shut-off position when the load pressure or the accumulator pressure reaches the maximum pressure.

Advantageously, the shut-off valve is also the filling valve and is precontrolled by a pilot-valve arrangement, with the result that its valve piston may be large and it is possible to open large flow cross sections and thus, with the damping system activated, to allow hydraulic-fluid exchange between the hydraulic cylinder and hydraulic accumulator without throttling. The valve piston of the shut-off valve can be forced in the opening direction by the load pressure and in the closing direction by a pressure prevailing in a control chamber and by a closing spring. The closing spring causes the accumulator pressure to be smaller than the load pressure in each case by a difference in pressure equivalent to the force of the closing spring. The control chamber of the shut-off valve can be connected, via the pilot-valve arrangement, to the hydraulic accumulator for the purpose of charging the hydraulic accumulator, to the pressure chamber of the hydraulic cylinder for the purpose of shutting off the hydraulic accumulator and to a tank for the purpose of flow taking place through the shut-off valve in a directionally independent manner.

As in the case of a directly actuated or else precontrolled shut-off valve which does not also have the function of filling valve at the same time, it is also possible, then, with a shut-off valve according to a feature of the invention for the actuating element of the pilot valve, in dependence on whose control position the control chamber of the shut-off valve can be subjected to load pressure or can be relieved of load in relation to the tank, to be deactivated when the load pressure or the accumulator pressure reaches the maximum pressure.

Alternatively, the pilot valve can be switched over by an actuating piston, which acts counter to the activated actuating element and a spring and is subjected to the action of the load pressure or of the accumulator pressure, from one position, in which flow can take place through the shut-off valve in a directionally independent manner, into another position, in which the shut-off valve is shut off, when the load pressure or the accumulator pressure reaches the maximum pressure. The spring acts on the actuating piston independently of the pilot-valve element which is to be operated, in order that it does not always attempt to move the same into a certain control position, and is prestressed for the purpose of predetermining the maximum pressure. A shut-off valve according to a feature of the invention can have a pilot-valve arrangement with two pilot valves. Another feature of the invention is a pilot-valve arrangement with a pilot valve with a spring-centered central position. In this case, the pilot valve also protects the hydraulic accumulator against excessive pressures during the charging operation, that is to say during the working cycle with the damping system not activated. This is because the pilot valve is moved by the actuating piston from the second control position into the third control position when a pressure corresponding to the prestressing of the spring acting on the actuating piston independently of the valve element which is to be operated is reached.

A feature of the invention provides a pilot-valve arrangement of the shut-off valve with two pilot valves which, nevertheless, are connected up to one another, and to the control chamber of the shut-off valve. The first pilot valve has a first connection, at which, depending on the position of a second pilot valve operated by activation of an actuating element, accumulator pressure or tank pressure is present, a second connection, at which load pressure is present, and a third connection, which is connected to the control chamber of the shut-off valve. In a first control position, which the first pilot valve assumes under the action of a spring, the first connection and the third connection are connected to one another and, in a second control position, into which the first pilot valve can be switched over by an actuating piston, which acts counter to a prestressed spring and is subjected to the action of the load pressure or the accumulator pressure, when the load pressure or the accumulator pressure reaches the limit pressure, the second connection and the third connection are connected to one another. The limit pressure is equivalent to the force of the prestressed spring. Without the prestressing being changed, the actuating piston is active, irrespective of the control position of the second pilot valve, whenever the limit pressure is reached. The charging pressure in the hydraulic accumulator cannot become higher than the limit pressure whether or not the damping system is activated. Maximum pressure and limit pressure thus correspond to one another. According to another feature of the invention the maximum pressure can be increased above the limit pressure in that the prestressing of the spring which acts counter to the actuating piston is changed, at the same time as the activation of the actuating element of the second pilot valve, from a value which corresponds to the limit pressure to a higher value. This advantageously takes place, in that the spring is supported on an adjustable prestressing piston which, upon activation of the actuating element, is subjected to the action of a pressure which displaces it with the effect of increasing the spring prestressing. If the directional control valve can be actuated hydraulically, then the maximum precontrol pressure is advantageously passed on to the prestressing piston in order to increase the spring prestressing.

In the case of a hydraulic control arrangement according to another feature of the invention, the spring acts on the actuating piston preferably via a valve piston of the first pilot valve. This renders a straightforward design possible.

A number of exemplary embodiments of a hydraulic control arrangement according to the invention and also a pilot valve which is used in one of the exemplary embodiments are illustrated in the drawings. The invention will now be explained in more detail with reference to the figures of these drawings, in which

DETAILED DESCRIPTION OF THE PREFERRED EMBODIMENT

Figure 1:
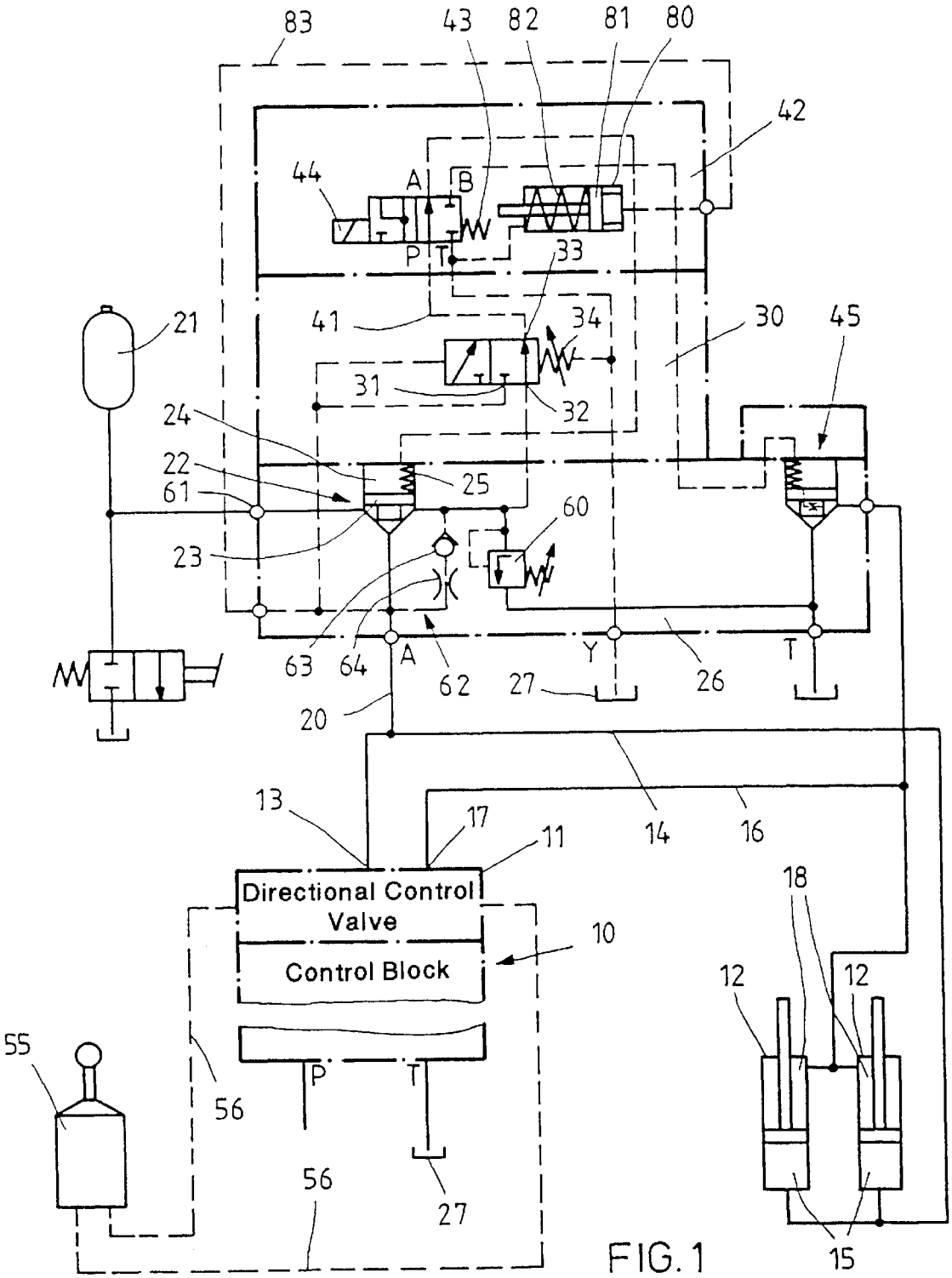
FIG. 1 shows the first exemplary embodiment, in which the filling line is connected to the working line, which leads to two hydraulic cylinders, and located in the filling line is a shut-off valve which, at the same time, also constitutes the filling valve and is precontrolled by two pilot valves, of which one can be moved from a first position into a second position by an electromagnet and from the second position into the first position by an actuating piston, counter to the excited electromagnet.

The hydraulic control arrangements shown are provided in each case for wheel loaders, tractors, telescopic handling equipment or other machines, and comprise a control block 10 with a plurality of directional control valves, in particular also with a directional control valve 11 which can assume a spring-centered central position and with the aid of which it is possible to activate two hydraulic cylinders 12 which are constructed as differential cylinders and with the aid of which, for example, the boom of a wheel loader can be raised and lowered. The directional control valve 11 has a first working connection 13 from which a first working line 14 leads to the base-side pressure chambers 15 of the hydraulic cylinders 12. A second working line 16 runs between a second working connection 17 of the directional control valve 11 and the piston-rod-side pressure chambers 18 of the hydraulic cylinders 12. The two working connections 13 and 17 can be connected to a hydraulic-fluid source and to a tank 27 via a pressure connection P and a tank connection T. The directional control valve 11 of the control block 10 can be actuated in a hydraulically proportional manner, the precontrol pressures being produced with the aid of a hydraulic precontrol unit 55 and being passed on to the directional control valve 11 via control lines 56.

In the embodiment according to FIG. 1, a filling line 20 which leads to a hydraulic accumulator 21 branches off from the working line 14. Located in the filling line are a connection A of a plate 26, a shut-off valve 22, which is installed in the plate 26, is constructed as a two-way cartridge valve and has a moveable valve element 23, and a connection 61 of the plate 26, from which a section of the filling line 20 extends to the hydraulic accumulator 21. The shut-off valve is, at the same time, the filling valve. The valve element 23 is a differential piston which can be seated on a seating cone, with the end side of the piston section of smaller diameter, in the manner of a seat valve, but it may also be a straightforward piston without an annular surface. At said end surface, the valve element 23 is forced in the opening direction by the pressure prevailing in the working line 14, that is to say by the load pressure prevailing in the base-side pressure chambers 15 of the two hydraulic cylinders 12. The accumulator pressure acts in the opening direction at the annular surface between the two piston sections of the valve element 23. The valve element 23 is forced in the closing direction by a pressure prevailing in a rear control chamber 24 and by a weak compression spring 25.

A first pilot valve 42 and a second pilot valve 30 are constructed on the plate 26 with the two-way cartridge valve 22. The second pilot valve 30 is a 3/2-way valve with a first inlet 31, which is connected to that section of the filling line 20 which is located between the working line 14 and the shut-off valve 22, and with a second inlet 32, which is connected to the hydraulic accumulator 21. An outlet 33 of the pilot valve 30 can be connected either to the inlet 31 or to the inlet 32 in dependence on the load pressure in the working line 14. To be specific, an adjustable, prestressed compression spring 34 acts on the valve element (not illustrated specifically) of the pilot valve 30 with the effect of connecting the outlet 33 to the inlet 32. The valve element is subjected to the action of the pressure in the inlet 31, that is to say of the base-side load pressure of the hydraulic cylinders 12, with the effect of connecting the outlet 33 to the inlet 31.

From the outlet 33 of the pilot valve 30, a control channel 41 leads to a first connection P of the first pilot valve 42, which is a 4/2-way valve. The valve element of the latter assumes a rest position, under the action of a compression spring 43, in which there is a through-passage between the first connection P and the third connection A, which is connected to the control chamber 24 of the shut-off valve 22. A tank connection (second connection) T and a further connection B of the pilot valve 42 are shut off in the rest position of the latter. The tank connection is connected to a leakage connection Y of the plate 26 via channels leading through the housings of the different valves. The connection B of the pilot valve 42 is connected to the rear control chamber of a second two-way cartridge valve 45, which is located in the plate 26 and via which the piston-rod-side pressure chambers 18 of the hydraulic cylinders 12 can be connected to a tank connection T of the plate 26. The valve element of the pilot valve 42 can be moved by an electromagnet 44 into a second control position, in which the connection P is shut off and the two connections A and B are connected to the connection T.

A fluid path 62 runs, in the bypass to the shut-off valve 22, within the plate 26 between the connections 61 and A thereof, that is to say, ultimately, between the hydraulic accumulator 21 and the base-side pressure chambers 15 of the hydraulic cylinders 12, and arranged in series one behind the other in said fluid path are a nonreturn valve 63, which opens from the connection 61 in the direction of the connection A, that is to say from the hydraulic accumulator 21 in the direction of the pressure chambers 15, and a throttle 64. The nonreturn valve 63 and throttle 64 are thus located in the plate 26.

If the piston rods of the hydraulic cylinders 12 are to be extended, then the directional control valve 11 is actuated in such a direction that hydraulic fluids can flow from a hydraulic pump to the working line 14. The piston rods extend, and a load pressure which is determined by the load which is moved by the hydraulic cylinders 12 prevails in the pressure chambers 15 of the hydraulic cylinders and in the working line 14. As long as the load pressure in the working line 14 remains below the pressure adjusted at the compression spring 34 of the pilot valve 30, said pilot valve switches the accumulator pressure through to the rear control chamber 24 of the shut-off valve 22 via the pilot valve 42. The load pressure then opens the shut-off valve 22 whenever it is above the accumulator pressure at least by the small difference in pressure equivalent to the force of the compression spring 25. Hydraulic fluid can then pass into the hydraulic accumulator 21 via the filling line 20, with the result that, disregarding the force of the weak compression spring 25, said hydraulic accumulator is charged to the load pressure in the working line 14. On account of the nonreturn valve 63, the hydraulic accumulator 21 cannot be charged via the fluid path 62.

If the load pressure falls, then the hydraulic accumulator can be discharged via the nonreturn valve 63 and the throttle 64. Accordingly, the charging pressure of the hydraulic accumulator 21 follows the falling load pressure and corresponds in each case to a quasi-stationary load pressure. On account of the throttle 64, rapid falling of the load pressure is followed by the charging pressure merely in a delayed manner, with the result that brief drops in pressure are barely noticeable in the hydraulic accumulator and the latter is not exposed to a high level of wear.

If the load pressure at the pilot valve 30 is able to overcome the force of the compression spring 34, the shut-off valve 22 remains closed. This is because, once the pilot valve 30 has been switched over, the load pressure is present in the rear control chamber 24 of the shut-off valve 22, with the result that, in conjunction with the compression spring 25, the shut-off valve 22 is kept closed in a reliable manner. The pressure in the hydraulic accumulator 21 thus cannot exceed the value adjusted at the compression spring 34 of the pilot valve 30. For safety reasons, however, a relief valve 60, of which the inlet is connected to the hydraulic accumulator 21, is additionally provided.

As the piston rods are extended, a pressure around the tank pressure prevails in the working line 16 and in the piston-rod-side pressure chambers 18 of the hydraulic cylinders 12.

Let us assume that the loading shovel of a wheel loader is loaded and that the wheel loader is traveling to an unloading site. Current is made to flow through the electromagnet 44 of the pilot valve 42 voluntarily by the driver if pitching vibrations occur or automatically at a certain speed of the mobile working machine, e.g. at a speed of 6 km/h, with the result that said valve switches over from the rest position shown into the other control position. The rear control chamber 24 of the shut-off valve 22 is then connected to the connection Y of the plate 26 via the pilot valve 42 and thus relieved of loading in relation to the tank 27.

The valve element 23 of the shut-off valve 22 is raised from its seat by the accumulator pressure and by the pressure in the working line 14, with the result that there is an open connection between the hydraulic accumulator 21 and the pressure chambers 15 of the hydraulic cylinders 12. Since the charging pressure of the hydraulic accumulator 21 has followed the load pressure occurring during the working cycle, the piston rods of the hydraulic cylinders 12 do not sink or extend during opening of the shut-off valve 22. A small difference between the load pressure and charging pressure caused by the weak spring 25 or by a weak spring of the nonreturn valve 63 does not have any noticeable effects. It may well be the case that load pressures which cause the valve 30 to switch and are thus not followed by the charging state of the hydraulic accumulator occur during the working cycle. However, these load pressures occur only in specific situations, e.g. when an object anchored in the ground is torn free or when the loading shovel is driven against a stop, but are not caused by the weight of the loading shovel and of the loading material, which acts solely when the wheel loader is traveling. The charging state of the hydraulic accumulator 21 is thus always sufficient in order to keep the loading shovel on the level assumed by the same during opening of the shut-off valve 22.

Hydraulic fluid can be displaced from the piston-rod-side pressure chambers 18 of the hydraulic cylinders 12 into the tank via the valve 45, which is likewise opened by the pilot valve 42 being switched over. Feeding can take place via feeding valves which are assigned to the directional control valve 11. This makes it possible to compensate for changes in volume of the pressure chambers 18 which occur during the open connection of the pressure chambers 15 to the hydraulic accumulator 21.

The relative movement between the boom and the vehicle body of the wheel loader makes it possible for pressures of such a magnitude to occur in the pressure chambers 15 of the hydraulic cylinders 12, and in the working line 14, that the hydraulic accumulator 21 could be damaged. Measures are thus taken in order to protect the hydraulic accumulator 21 against such high pressures. The pilot valve 42 is assigned a small actuating cylinder 80 with an actuating piston 81 by means of which, with the electromagnet 44 excited, the moveable valve element of the pilot valve 42 can be switched from the second control position into the rest position counter to the force of said electromagnet when the pressure in the pressure chambers 15 exceeds a maximum pressure. The actuating piston is subjected to loading by a compression spring 82, counter to the actuating direction, independently of the valve element of the pilot valve 42. It is thus not possible for the compression spring 82 to adjust the valve element. Its prestressing is selected in accordance with the desired maximum pressure, the force of the electromagnet 44 also being taken into account. On one side, the actuating piston 81 is forced in the actuating direction by the load pressure via a control line 83. As soon as the load pressure reaches the maximum pressure, it can displace the actuating piston 81 in the actuating direction, counter to the force of the compression spring 82 and counter to the force of the electromagnet 44, with the result that the valve element of the pilot valve 42 passes from its second control position into the rest position. Since the maximum pressure is at least equal to the limit pressure, in the case of which the pilot valve 30 is switched into its second control position, the control chamber 24 of the shut-off valve 22 is then connected to the working line 14 via the two pilot valves 30 and 42 and is subjected to the action of the pressure prevailing therein. The shut-off valve closes immediately. The high pressure is kept away from the hydraulic accumulator 21.

If the pressure in the working line 14 falls below the maximum pressure again, the actuating piston 81 is set back by the compression spring 82 and the electromagnet 44 is able to move the valve element of the pilot valve 42 into its second control position again, in which the control chamber 24 of the shut-off valve 22 is relieved of loading in relation to the tank. The shut-off valve 22 opens again and the damping of the pitching vibrations is initiated again.

Figure 2:
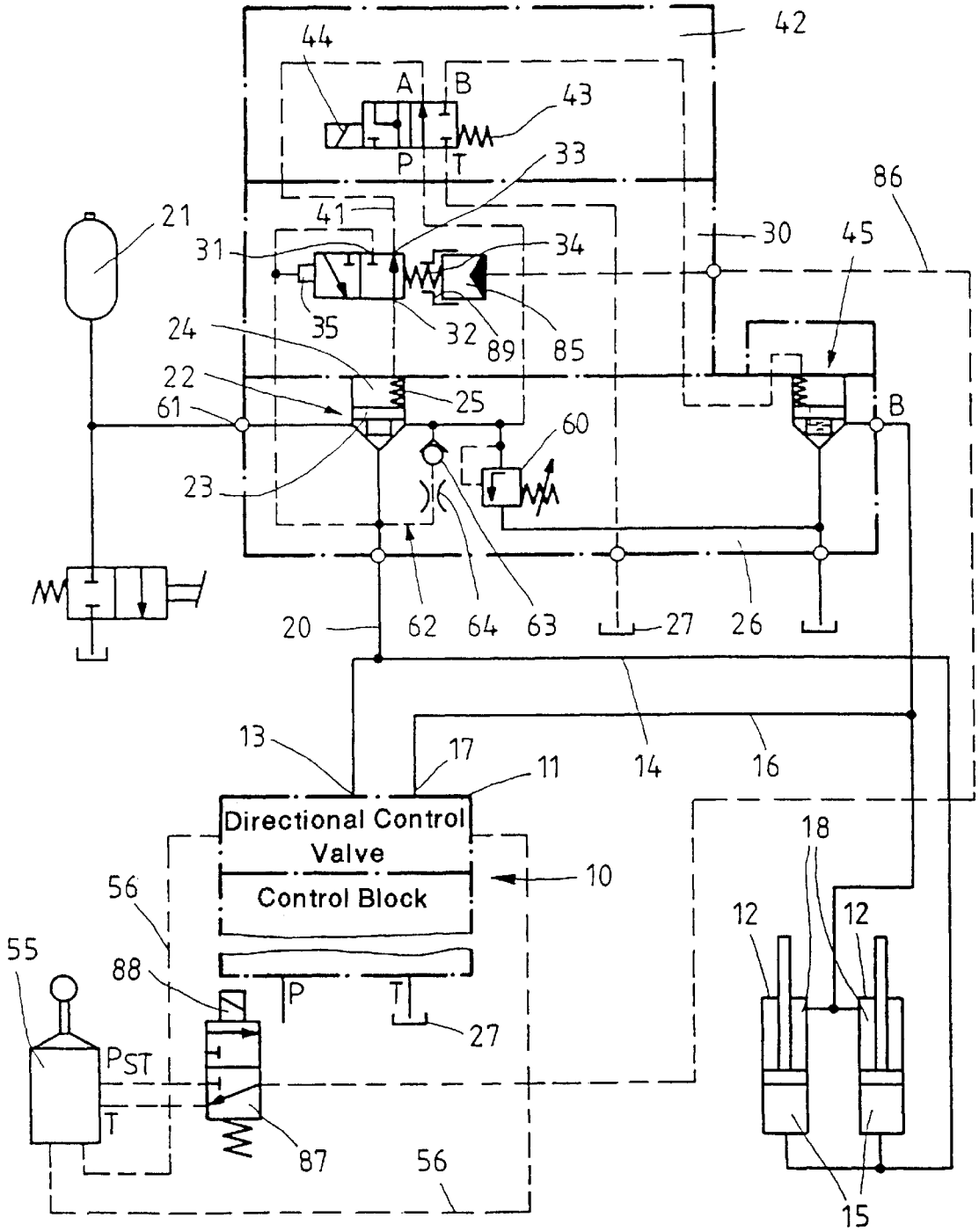
FIG. 2 shows a second exemplary embodiment, which has largely the same components as the first exemplary embodiment, although the two pilot valves are connected up differently and, rather than the pilot valve which can be actuated by an electromagnet, it is the other pilot valve which is operated in order to move the shut-off valve into its shut-off position with the damping system activated.

The embodiment according to FIG. 2 differs from the embodiment according to FIG. 1 first of all in the way in which the pilot valves 30 and 42 are connected up to one another and to the control chamber 24 of the shut-off valve 22. In this case, the connection 32 of the pilot valve 30 is connected to the control chamber 24 of the shut-off valve 22 and the connection 33 is connected to the connection A of the pilot valve 42. Precisely as in the embodiment according to FIG. 1, the connection 31 is connected to that section of the filling line 20 which is located between the working line 14 and the shut-off valve 22. By virtue of the load pressure present at the connection 31, the pilot valve 30 can be adjusted, counter to the force of the prestressed compression spring 34, via an actuating piston 35, which may also be the valve piston, with the effect of connecting the connections 31 and 32 to one another. If the load pressure is smaller than the limit pressure adjusted at the spring 34, then the pilot valve 30 is kept, by the spring, in a first control position, in which the connections 32 and 33 are open in relation to one another. The connection P of the pilot valve 42 is connected to the hydraulic accumulator 21. As far as the connections B and T are concerned, there are no changes in relation to the embodiment according to FIG. 1.

If, during a working cycle with the loading shovel, the pilot valves 30 and 32 are located in the control positions shown, the control chamber 24 of the shut-off valve 22 is connected to the hydraulic accumulator 21 via both pilot valves, with the result that said hydraulic accumulator is charged to the respective load pressure provided that the load pressure is smaller than the limit pressure adjusted at the compression spring 34. If this limit pressure is reached, the pilot valve 30 switches over, with the result that the load pressure is passed into the control chamber 24 and the shut-off valve 22 closes.

Without further measures, the pilot valve 30 would also be moved into its second control position by the load pressure with the pilot valve 42 in operation, that is to say with damping of the pitching vibrations activated, when the load pressure reaches the limit pressure. The maximum pressure and limit pressure would then correspond to one another. However, the hydraulic control arrangement according to FIG. 2 is configured such that the maximum pressure is higher than the limit pressure. For this purpose, the compression spring 34 is supported on a prestressing piston 85 and presses the same against a fixed stop (not illustrated specifically). The spring 34 is then subjected to stressing to such a pronounced extent that its force is equivalent to the limit pressure. A pressure chamber on the rear side of the prestressing piston 85, said rear side being directed away from the spring 34, is connected, via a control line 86, to a 3/2-way valve 87 which is seated on the precontrol unit 55 and in a rest position, which it assumes under the action of a compression spring, relieves the pressure chamber on the prestressing piston of loading in the direction of the tank connection of the precontrol unit. By virtue of an electromagnet 88, which is excited at the same time as the electromagnet 44 of the pilot valve 42, the directional control valve 87 can be moved into a second control position, in which the control chamber on the prestressing piston 85 is connected to the pressure connection of the precontrol unit 55. A pressure in the region of 30 bar is usually present at said pressure connection. If the directional control valve 87 is operated, then prestressing piston 85 is subjected to the action of a pressure in the region of 30 bar with the effect of prestressing the spring 34 to a more pronounced extent. The surface of the prestressing piston 85 is of such a magnitude that it prestresses the compression spring 34 to a relatively pronounced extent until it butts against a second stop 89. The prestressing of the compression spring 34 then corresponds to a maximum pressure, which is above the limit pressure. It is only when the load pressure reaches this maximum pressure that it is able to switch over the pilot valve 30 from the rest position shown into the second control position, in which the load pressure is passed into the control chamber 24 of the shut-off valve 22, with the result that the latter closes.

Figure 3:
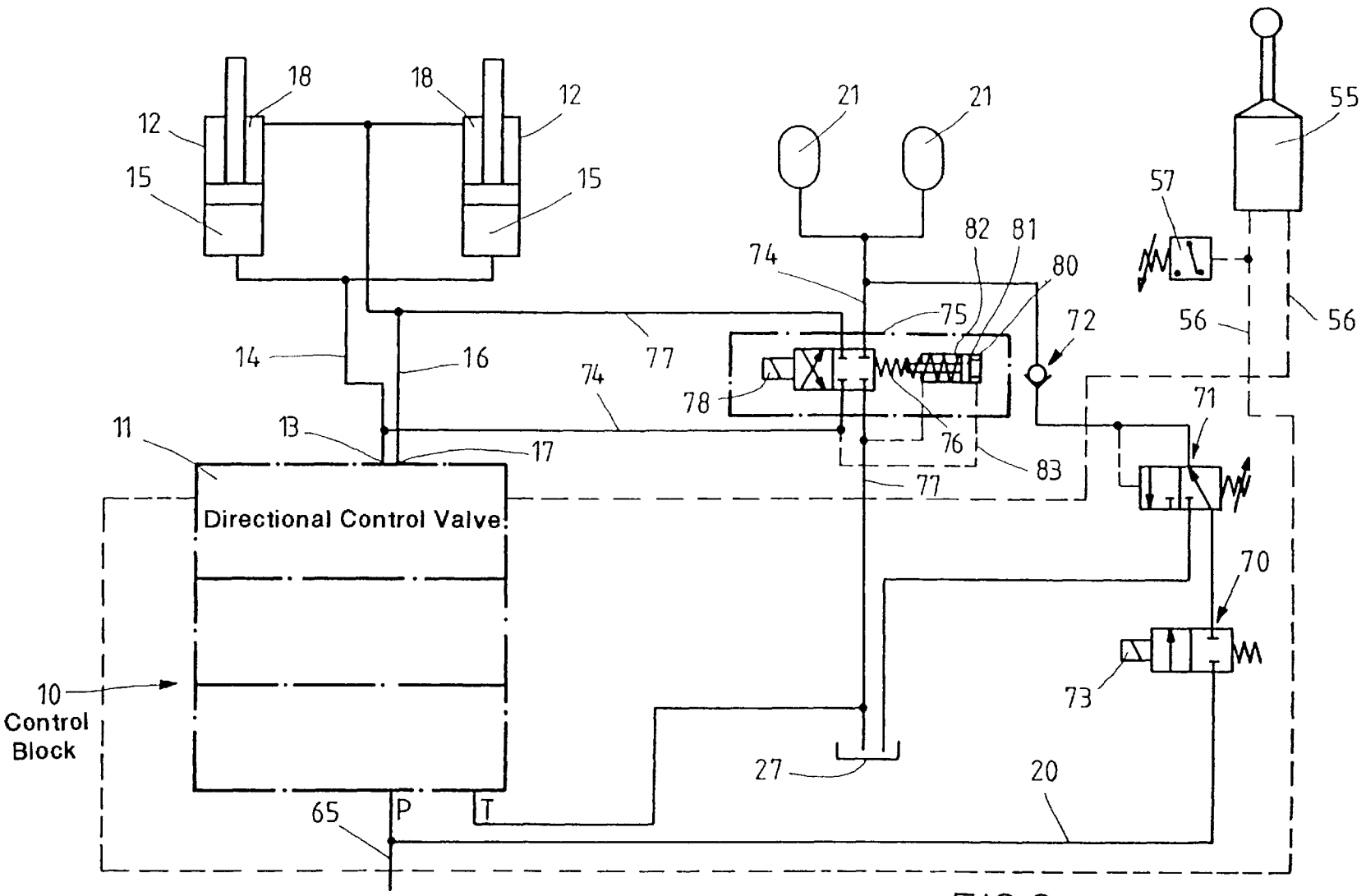
FIG. 3 shows a third exemplary embodiment, in which the filling line, in which a filling valve is located, branches off from the pump line upstream of the directional control valve and the hydraulic accumulator and the hydraulic cylinder can be connected to one another via an additional shut-off valve, it being possible for the shut-off valve to be moved into a through position by an electromagnet and into its shut-off position by an actuating piston, counter to the excited electromagnet.

In the embodiment according to FIG. 3, the filling line 20 branches off from a pump line 65 upstream of the valve control block 10. As seen in the flow direction of the hydraulic fluid from the pump line 65 to a plurality of hydraulic accumulators 21, first of all a 2/2-way valve 70, a pressure-regulating valve 71 and a nonreturn valve 72 are arranged in the filling line 20, which leads to the hydraulic accumulators 21. In the rest position of the directional control valve 70, said rest position being brought about by a compression spring, the two connections of said valve are shut off in relation to one another. The directional control valve can be switched into a through position by activation of an electromagnet 73. To be precise, the electromagnet 73 is excited whenever the directional control valve 11, which is located within the control block 10, is actuated in the raising direction for the purpose of activating the hydraulic cylinders 12. In the central position of the directional control valve 11, and with the latter actuated in the lowering direction, the directional control valve 70 is located in its starting position.

A limit pressure up to which the hydraulic accumulators 21 can be charged is adjusted at the pressure-regulating valve 71. As long as this pressure has not been reached, the pressure-regulating valve switches the outlet of the directional control valve 70 through to the nonreturn valve 72. When the pressure is reached, the inlet of the valve 71, said inlet being connected to the outlet of the directional control valve 70, is shut off and the connection which is connected to the nonreturn valve is connected to the tank.

The hydraulic accumulators 21 may be connected, via a line 74, to working line 14, which runs between the working connection 13 of the directional control valve and the pressure chambers 15 of the hydraulic cylinders 12. Installed in said line 74 is a 4/2-way valve 75 which assumes, under the action of a compression spring 76, a rest position in which two sections of the line 74 are shut off in relation to one another and there is thus no connection between the hydraulic accumulators 21 and the working line 14. In addition to the two connections which are necessary for opening and closing the line 74, the directional control valve 75 has two further connections for two sections of a line 77, which leads to the tank 27 from the working line 15 between the directional control valve 11 and the pressure chambers 18 of the hydraulic cylinders 12. In the rest position of the directional control valve 75, the two sections of the line 77 are also shut off in relation to one another. The directional control valve 75 can be moved by an electromagnet 78 into a control position in which in each case the two sections of the line 74 and the two sections of the line 77 are connected to one another. The electromagnet 78 is excited when, as first condition, the working machine equipped with the hydraulic control arrangement shown exceeds a certain traveling speed. The hydraulic accumulators 21 are then connected to the pressure chambers 15 of the hydraulic cylinders 12, with the result that pitching vibrations can be damped. It is thus possible to compensate for changes in volume of the pressure chambers 18 via the line 77.

Precisely as in the embodiment according to FIG. 1 for the pilot valve 42, there is provided in this case for the shut-off valve 75 a small actuating cylinder 80 with an actuating piston 81 which is pushed, by a prestressed compression spring 82, into a rest position, in which it butts against a fixed stop. A control chamber on that side of the actuating piston 81 which is directed away from the spring chamber is, in turn, connected to the working line 14 via a control line 83. The prestressing of the compression spring 82 is pronounced enough for it to be possible for the actuating piston 81, with the force of the electromagnet 78 being taken into account, to switch the valve piston of the valve 75 into the shut-off position only in the case of a maximum pressure in the working line 14, which is equal to, and preferably higher than, the limit pressure to which the valve 71 is adjusted. The hydraulic accumulators 21 are thus also separated, with damping of the pitching vibrations activated, from the pressure chambers 15 of the hydraulic cylinders when the pressure therein exceeds a detrimental maximum pressure.

Figure 4:
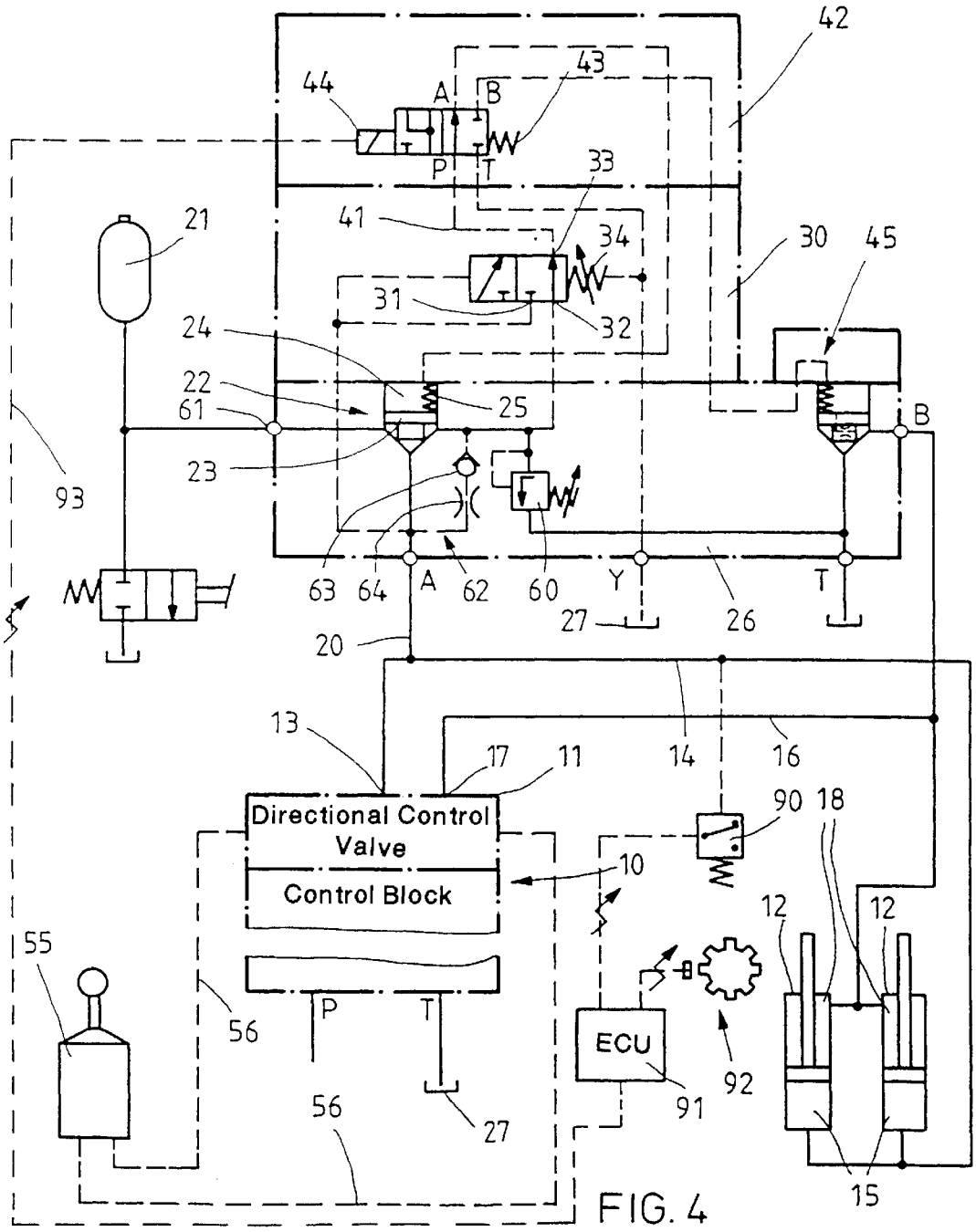
FIG. 4 shows a fourth exemplary embodiment, which, apart from the actuating piston for the pilot valve which can be actuated electromagnetically, is the same as the first exemplary embodiment as far as the hydraulic components and the hydraulic connections between the components are concerned, and in which, with the damping system activated, the electromagnet of one pilot valve is switched off when the pressure in the working line becomes too high.

Apart from the actuating cylinder 80, the exemplary embodiment according to FIG. 4 corresponds fully to the exemplary embodiment according to FIG. 1 as far as the hydraulic components and the way in which they are connected up are concerned. There is provided an electric pressure switch 90 which is connected to the working line 14 and emits an electric signal to an electric control unit 91 when the pressure in the working line 14 exceeds a maximum pressure, which is equal to, or preferably higher than, the limit pressure, which is equivalent to the force of the prestressed spring 34 of the pilot valve 30. The electric control unit 91, moreover, receives signals from a tachometer 92 which serves for sensing the speed of the mobile working machine. The electric control unit 91 is connected to the electromagnet 44 of the pilot valve 42 via an electric control line 93. The electromagnet 44 is excited when the signal of the tachometer 92 indicates a speed above a limit value and when the pressure switch 90 does not detect, in the working line 14, any load pressure above the maximum pressure. The pilot valve 42 has been moved by the electromagnet 44 into its second control position, in which the control chamber 24 of the shut-off valve 22 is relieved of loading in relation to the tank. The shut-off valve opens and the pressure chambers 15 of the hydraulic cylinders 12 are connected to the hydraulic accumulator 21, with the result that pitching vibrations are damped. If the pressure switch 90 detects, in the working line 14, a pressure above the maximum pressure, then the electromagnet 44 is de-excited and the compression spring 43 moves the pilot valve 42 into its control position shown in FIG. 4. In this control position, the control chamber 24 of the shut-off valve 22 is connected to the connection 33 of the pilot valve 30. Since the maximum pressure is at least equal to the limit pressure, at which the pilot valve 30 is moved into its second control position, the latter is located in said second control position, in which the connection 33 is connected to the connection 31, with the result that the pressure from the working line 14 is passed into the control chamber 24 of the shut-off valve 22. The shut-off valve 22 thus closes, with the result that the hydraulic accumulator 21 is protected against the high pressure. Once the pressure in the working line 14 has fallen below the maximum pressure, the electromagnet 44 is excited again and the control chamber 24 of the shut-off valve 22 is relieved of loading in relation to the tank irrespective of the control position of the pilot valve 30, with the result that the shut-off valve opens again.

Figure 5:
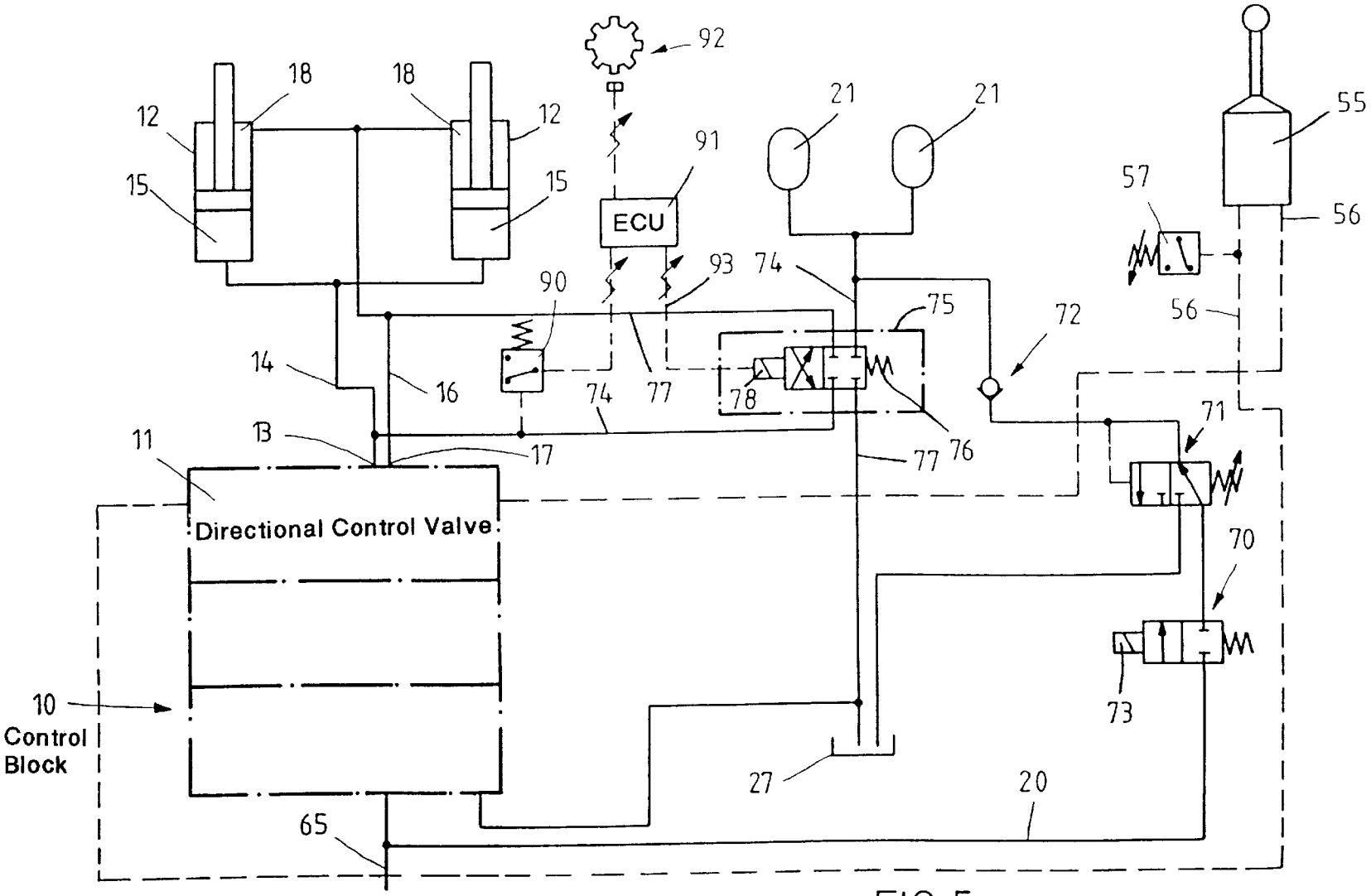
FIG. 5 shows a fifth exemplary embodiment, which, apart from the actuating piston for the shut-off valve, corresponds to the exemplary embodiment according to FIG. 3, and in which the electromagnet of the shut-off valve is switched off when, with the damping system activated, the pressure in the hydraulic cylinders becomes too high.

As with the case of the embodiment according to FIG. 4 that, unlike the embodiment according to FIG. 1, a pressure switch 90 is provided instead of the actuating cylinder 80, this is also the case with the two embodiments according to FIGS. 3 and 5. Apart from the actuating cylinder 80, the embodiment according to FIG. 5 thus corresponds to the embodiment according to FIG. 3 as far as the hydraulic components and the way in which they are connected up to one another are concerned. The pressure switch 90 emits a signal to the electric control unit 91 when the pressure in the working line 14 reaches the maximum pressure. The electric control unit, moreover, receives signals from the tachometer 92 and activates the electromagnet 78 of the shut-off valve 75 via the control line 93 when the tachometer 92 signals a working-machine speed above a certain value and when there is no signal from the pressure switch 90, that is to say when the pressure in the pressure chambers 15 of the hydraulic cylinders 12 is below the maximum pressure. As soon as this pressure rises above the maximum pressure, the electromagnetic 78 is de-excited and the valve 75 passes into the position shown in FIG. 5. The hydraulic accumulators 21 are shut off in the direction of the pressure chambers 15.

Figure 6:
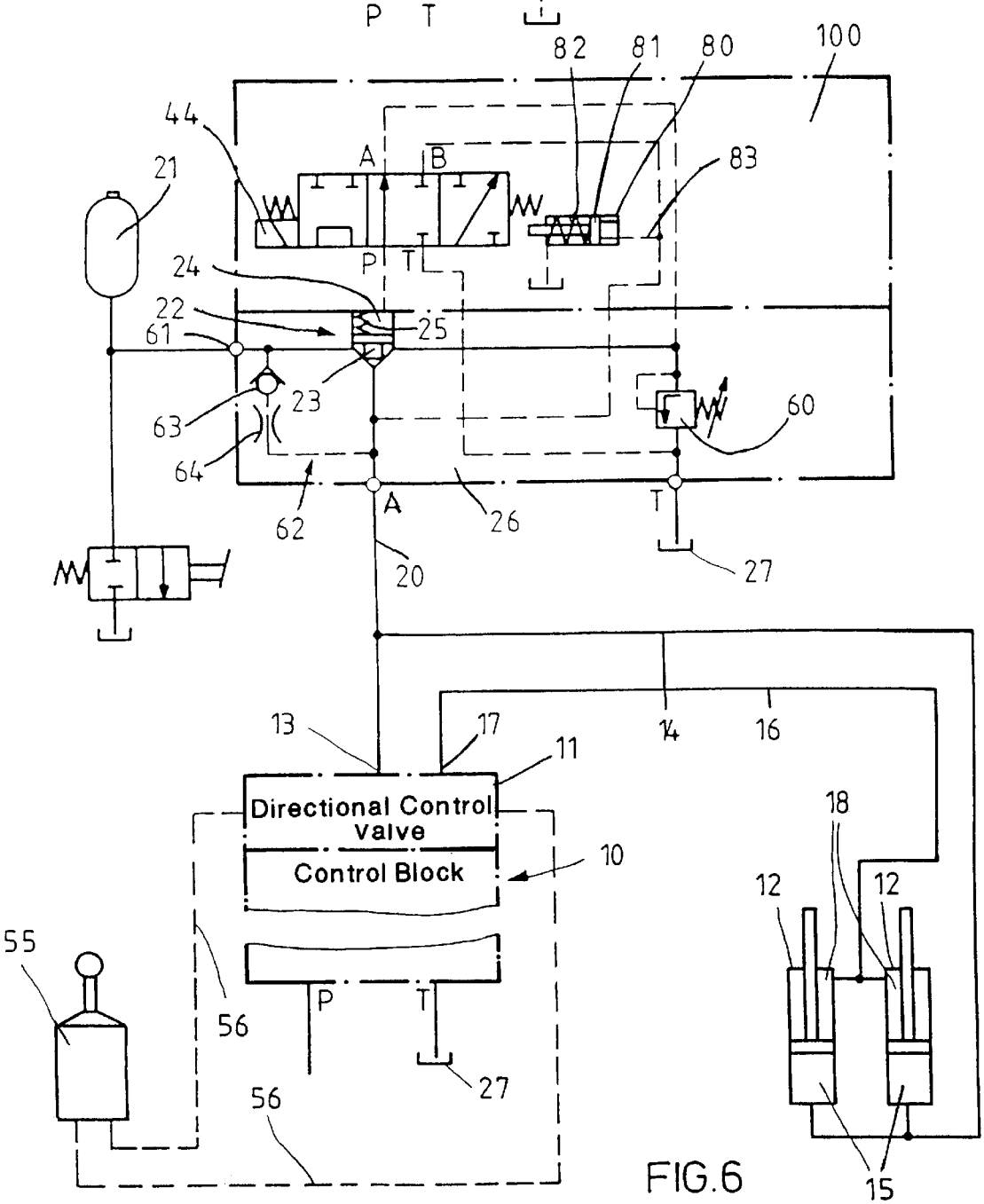
FIG. 6 shows an exemplary embodiment which is similar to those from FIGS. 1 and 2 but in which a pilot valve with three control positions is provided.

The embodiment according to FIG. 6 may be regarded as being produced from the embodiment according to FIG. 1 in that the two pilot valves 30 and 32 are combined to form a single pilot valve 100 which has a spring-centered central position, a lateral, second control position and a further lateral, third control position. The pilot valve has four connections which, like the connections of the valve 42 from FIG. 1, are designated by the letters P, T, A and B. In contrast to the embodiment according to FIG. 1, however, the cartridge valve 45 from FIG. 1 is not present in the embodiment according to FIG. 6. Volume compensation in the pressure chambers 18 of the hydraulic cylinders 12 takes place, when the damping of the pitching vibrations is active, via the directional control valve 11 alone.

The connection P of the pilot valve 100 is connected directly to the control chamber 24 of the shut-off valve 22, the connection A is connected to the hydraulic accumulator 21, the connection B is connected to the filling line 20 and the connection T is connected to the tank. In the central position, the connections B and T are shut off, while there is a through-passage between the connections P and A. The accumulator pressure is thus present in the control chamber 24 of the shut-off valve 22. The pilot valve 100 can be moved into the second control position by the electromagnet 44. The connections A and B are then shut off and the connections P and T are connected to one another. The control chamber 24 is thus relieved of loading in relation to the tank, with the result that the shut-off valve 22 is open. The pilot valve 100 is moved into the third control position by the actuating piston 81, which operates counter to the prestressed compression spring 82, as soon as the pressure in the working line 14, that is to say in the pressure chambers 15 of the hydraulic cylinders, reaches a limit pressure, with the magnet 44 switched off, and, with the magnet 44 switched on, reaches a maximum pressure, which is higher than the limit pressure in accordance with the force of the electromagnet 44. In the third control position, the connections A and T of the pilot valve 100 are shut off, while the connections P and B, and thus the control chamber 24 and the pressure chambers 15 of the hydraulic cylinders 12, are connected to one another. The shut-off valve 22 is then located in its shut-off position.

Since, during the normal working cycle with the loading shovel, the electromagnet 44 is not excited, the actuating piston 81 switches the valve 100 over into the third control position as soon as the load pressure reaches a limit pressure, which is predetermined solely by the prestressing of the spring 82 and by the centering of the valve. Following activation of the damping of the pitching vibrations, the electromagnet 44 is excited, with the result that the actuating piston 81 still also has to overcome the force of the electromagnet. It thus switches the valve 100 only in the case of a maximum pressure, which is above the limit pressure.

If the limit pressure and maximum pressure are to be equal, then, when the pressure in the pressure chambers 15 of the hydraulic cylinders 12 reaches the limit pressure, the electromagnet 44 is switched off in addition.

Figure 7:
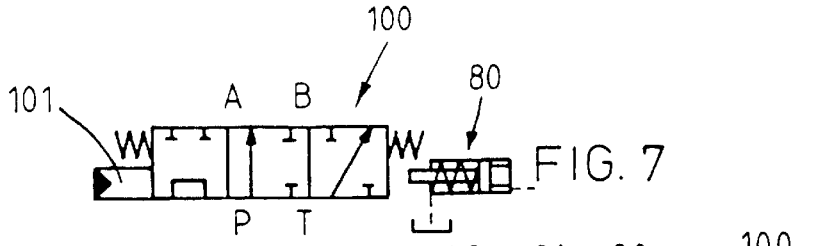
FIG. 7 shows a three-position pilot valve of a seventh exemplary embodiment, with the actuation of the pilot valve being different from that of FIG. 6.

The pilot valve 100 according to FIG. 7 is moved into the second control position not by an electromagnet but by an actuating piston 101 which can be subjected to the action of pressure and acts counter to the centering spring arrangement. Actuation into the third control position takes place, as with the pilot valve 100 according to FIG. 6, by an actuating cylinder 80 with actuating piston 81 and prestressing spring 82.

Figure 8:
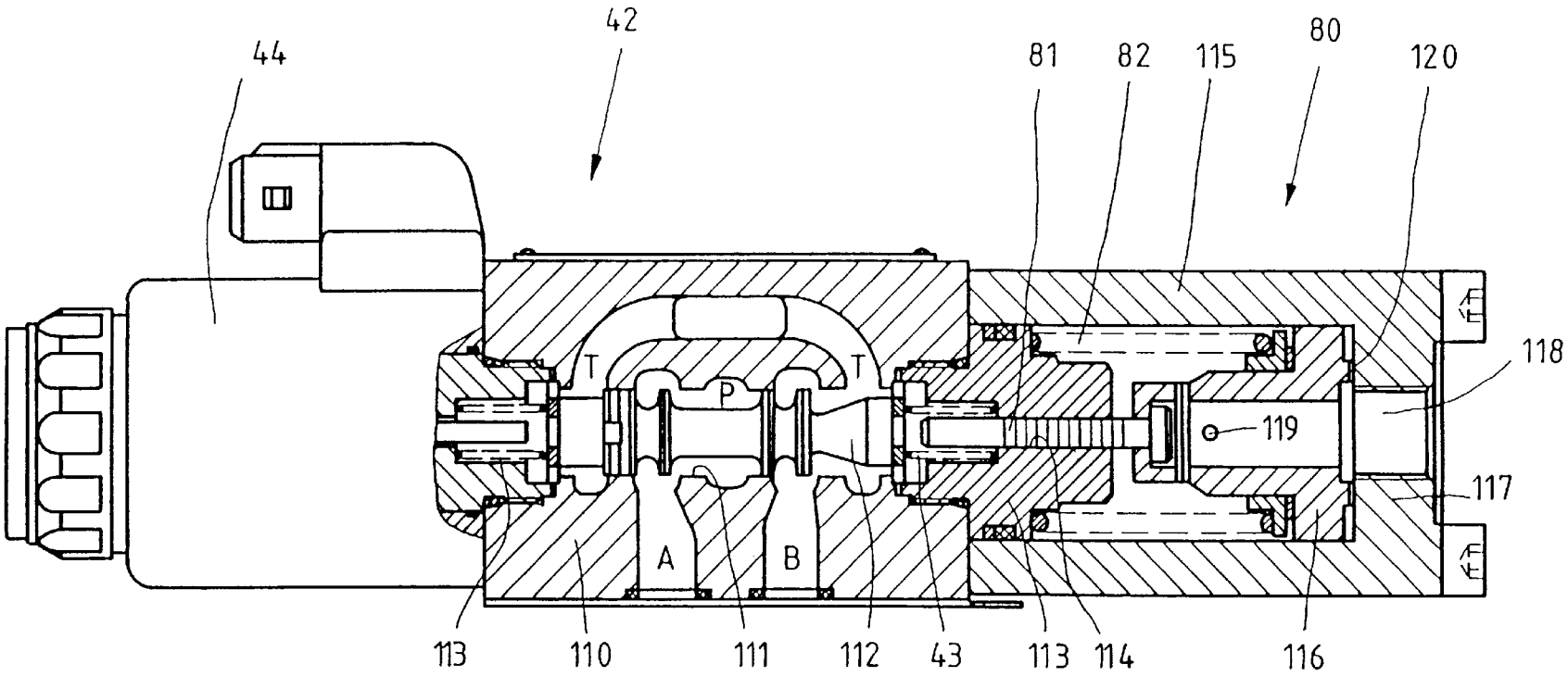
FIG. 8 shows a section through the electromagnetically actuable pilot valve of an embodiment similar to that from FIG. 1.

The pilot valve shown in FIG. 8 corresponds to the pilot valve 42 according to FIG. 1 with one difference. This difference consists in that, in this case, the two connections T and B are connected to one another in the rest position, the connection B being shut off rather than continued to a cartridge valve 45.

A valve housing 110 has a valve bore 111 in which a pilot piston 112 can be displaced axially. The pilot piston is indeed centered by two compression springs 43 and 113 because use is made of a valve housing 110 which can also be used for other applications, but, as far as the connection of the connection A to the connection P is concerned, there is no difference between the central position and a lateral position, in which the pilot piston 112 is displaced, in the direction of the electromagnet 44, into an end position. The essential feature is the restoring spring 43, which sets the pilot piston 112 back again when the electromagnet 44 is de-excited, having previously moved the pilot piston 112 into a control position in which the connection A was connected to the connection T. The spring 113 ensures that the pilot piston cannot move freely back and forth between the spring plate assigned to the spring 43 and a stop on the electromagnet 44.

On the side located opposite the electromagnet 44, the valve bore 111 is closed off by a screwed-in insert 113 which serves as abutment for the spring 43 and, coaxially with the valve bore 111, has a through-bore 114 of considerably smaller diameter than the valve bore 111. The insert 113 may also be regarded as a cover of the actuating cylinder 80, of which the housing 115 is screwed firmly to the valve housing 110. The actuating cylinder 80 is a single-acting cylinder or plunger cylinder, of which the actuating piston 81 projects through the central through-passage 114 of the insert 113 into the interior of the compression spring 43. The effective piston diameter corresponds to the diameter of the central through-passage 114. The actuating piston is fitted in captive fashion in a spring plate 116 which is pressed against a base 117 of the cylinder housing by the helical compression spring 82, which is clamped in between it and the insert 113. If the spring plate 116 butts against the base 117, the actuating piston 81 is spaced apart from the pilot piston 112 by a sufficiently large distance for the electromagnet 44 to be able to move the pilot piston 112 into its second control position. Located in the base 117 is a connection opening which is provided with a thread and via which the interior of the actuating cylinder 80 can be connected to a working line 14 or to that section of a filling line 20 which is connected to the working line 14. Corresponding bores 119 and recesses 120 in the spring plate 116 ensure that all areas of the interior of the actuating cylinder 80 are connected freely to the connection opening 118.

The effective cross section of the actuating piston 81 is selected to be very small, with the result that the size of the prestressing spring 82 also remains with reasonable limits and the actuating cylinder 80 produced is a compact unit which does not exceed the size of the valve housing 110.

We claim:

1. A hydraulic control arrangement for a mobile working machine, in particular for a wheel loader, having at least one hydraulic cylinder (12) with the aid of which a working tool can be moved, comprising a directional control valve (11) for controlling the hydraulic-fluid paths between a pressure chamber (15) of the hydraulic cylinder (12), a hydraulic-fluid source and a tank (27), a hydraulic accumulator (21) which is connectable to the hydraulic-fluid source via a filling valve (22; 71), located in a filling line (20), of which the charging pressure is increaseable to a limit pressure via the filling valve (22; 71) and which is connectable to the pressure chamber (15) of the hydraulic cylinder (12) for damping pitching vibrations of the working machine, and a shut-off valve (22; 75) which, with a first condition fulfilled, is moveable into a through position in which hydraulic fluid is flowable through it in the direction from the hydraulic accumulator (21) to the pressure chamber (15) of the hydraulic cylinder (12) and vice versa, wherein the shut-off valve (22; 75) is also moveable, with the first condition fulfilled, into its shut-off position when the load pressure in the pressure chamber (15) of the hydraulic cylinder (12) or the accumulator pressure reaches a maximum pressure.

2. The hydraulic control arrangement as claimed in claim 1, wherein the maximum pressure is higher than the limit pressure.

3. The hydraulic control arrangement as claimed in claim 1, wherein the shut-off valve (75) assumes a shut-off position under the action of a spring (76) and, by activation of an actuating element (78), is switchable over into the through position, in which flow can take place through it in a directionally independent manner, and wherein the actuating element (78) is deactivated when the load pressure or the accumulator pressure reaches the maximum pressure.

4. The hydraulic control arrangement as claimed in claim 3, wherein the actuating element is an electromagnet (44).

5. The hydraulic control arrangement as claimed in claim 1, wherein the shut-off valve (75) assumes a shut-off position, under the action of a spring (76), in which the hydraulic accumulator (21) is chargeable via the filling valve (71), and, by activation of an actuating element (78), is switchable over into the through position, in which flow can take place through it in a directionally independent manner, and wherein the shut-off valve (75) is switchable over by an actuating piston (81), which acts counter to the activated actuating element (78) and a spring (82) and is subjected to the action of the load pressure or of the accumulator pressure, from the through position into the shut-off position when the load pressure or the accumulator pressure reaches the maximum pressure.

6. The hydraulic control arrangement as claimed in claim 5, wherein the actuating element is an electromagnet (44).

7. The hydraulic control arrangement as claimed in claim 1, wherein the shut-off valve (22) is also the filling valve, is precontrolled by a pilot-valve arrangement (30, 42; 100) and has a valve piston (23) which can be forced in opening direction by the load pressure and in closing direction by a pressure prevailing in a control chamber (24) and by a closing spring (25), and wherein the control chamber (24) is connectable, via the pilot-valve arrangement (30, 42; 100), to the hydraulic accumulator (21) for charging the hydraulic accumulator (21), to the pressure chamber (15) of the hydraulic cylinder (12) for shutting off the hydraulic accumulator (21) and to a tank (27) for the purpose of flow taking place through the shut-off valve (22) in a directionally independent manner.

8. The hydraulic control arrangement as claimed in claim 7, wherein the shut-off valve (22) is precontrolled by at least one pilot valve (42; 100), and the control chamber (24) of the shut-off valve (22) is subjectable to the action of load pressure in a first position of the pilot valve (42; 100), assumed under the action of the spring (43), and is relievable of loading in relation to the tank (27) in a second position of the pilot valve (42; 100), into which the pilot valve (42; 100) is switchable over by activation of an actuating element (44), and wherein the actuating element (44) of the pilot valve (42; 100) is deactivated when the load pressure or the accumulator pressure reaches the maximum pressure.

9. The hydraulic control arrangement as claimed in claim 7, wherein a pilot valve (42; 100) of the shut-off valve (22) is switchable over, by activation of an actuating element (44), into a position in which flow can take place through the shut-off valve (22) in a directionally independent manner, and wherein the pilot valve (42; 100) is switchable over by an actuating piston (81), which acts counter to the activated actuating element (44) and a spring (82) and is subjected to the action of the load pressure or of the accumulator pressure, from one position into another position, in which the shut-off valve (22) is shut off, when the load pressure or the accumulator pressure reaches the maximum pressure, and wherein the spring (82) acts on the actuating piston (81) independently of the valve element (112) which is to be operated, and is prestressed for the purpose of predetermining the maximum pressure.

10. The hydraulic control arrangement as claimed in claim 9, wherein the pilot valve (42) has a first connection (P), at which, depending on the position of a second pilot valve (30) operated in a pressure-dependent manner, accumulator pressure or load pressure is present, a second connection (T), which is applied to the tank (27), and a third connection (A), which is connected to the control chamber (24) of the shut-off valve (22), wherein, in a first control position of the first pilot valve (42), the first connection (P) and the third connection (A) are connected to one another and, in a second control position, into which the first pilot valve (42) is switchable by activation of the actuating element (44), the second connection (T) and the third connection (A) are connected to one another, and wherein the first pilot valve (42) is switchable over by the actuating piston (81) from the second control position into the first control position when the load pressure or the accumulator pressure reaches the maximum pressure.

11. The hydraulic control arrangement as claimed in claim 9, wherein the pilot valve (100) has a first connection (A), at which the accumulator pressure is present, a second connection (T), which is applied to the tank (27), a third connection (P), which is connected to the control chamber (24) of the shut-off valve (22), and a fourth connection (B), at which the load pressure is present, wherein in a spring-centered central position of the pilot valve (100), the first connection (A) and the third connection (P) are connected to one another, in a lateral, second control position, into which the pilot valve (100) is switchable by activation of the actuating element (44), the second connection (T) and the third connection (P) are connected to one another and, in a lateral, third control position, the third connection (P) and the fourth connection (B) are connected to one another, and wherein the pilot valve (100) is switchable over by the actuating piston (81) from the second control position into the third control position when the load pressure or the accumulator pressure reaches the maximum pressure.

12. The hydraulic control arrangement as claimed in claim 7, wherein the pilot-valve arrangement comprises a first pilot valve (30) which has a first connection (33), at which, depending on the position of a second pilot valve (42) operated by activation of an actuating element (44), accumulator pressure or tank pressure is present, a second connection (31), at which load pressure is present, and a third connection (32), which is connected to the control chamber (24) of the shut-off valve (22), wherein, in a first control position, which the first pilot valve (30) assumes under the action of a prestressed spring (34), the first connection (33) and the third connection (32) are connected to one another and, in a second control position, into which the first pilot valve (30) is switchable over in particular by an actuating piston (35), which acts counter to the prestressed spring (34) and is subjected to the action of the load pressure or the accumulator pressure, when the load pressure or the accumulator pressure reaches the limit pressure, the second connection (31) and the third connection (32) are connected to one another.

13. The hydraulic control arrangement as claimed in claim 12, wherein the prestressing of the spring (34), which acts counter to the actuating piston (35), can be changed, at the same time as the activation of the actuating element (44) of the second pilot valve (42), from a value which corresponds to the limit pressure to a value corresponding to the higher maximum pressure.

14. The hydraulic control arrangement as claimed in claim 13, wherein the spring (34) is supported on an adjustable prestressing piston (85) which, upon activation of the actuating element (44), is subjected to the action of a pressure which displaces it with the effect of increasing the spring prestressing.

15. The hydraulic control arrangement as claimed in claim 14, wherein connected to a pressure chamber on the prestressing piston (85) is a valve (87) which is switched, at the same time as the second pilot valve (42), from a first control position into a second control position and, in the first control position, relieves the pressure chamber of loading and, in the second control position, connects the pressure chamber to a pressure source, in particular to the pressure source for the maximum precontrol pressure for the hydraulically actuable directional control valve (11).

16. The hydraulic control arrangement as claimed in claim 15, wherein the spring (34) acts on the actuating piston (36) via a valve piston of the first pilot valve (30).

17. The hydraulic control arrangement as claimed in claim 14, wherein the spring (34) acts on the actuating piston (36) via a valve piston of the first pilot valve (30).

18. The hydraulic control arrangement as claimed in claim 13, wherein the spring (34) acts on the actuating piston (36) via a valve piston of the first pilot valve (30).

19. The hydraulic control arrangement as claimed in claim 12, wherein the spring (34) acts on the actuating piston (36) via a valve piston of the first pilot valve (30).

20. The hydraulic control arrangement as claimed in claim 7, wherein the actuating element is an electromagnet (44).

* * * * *